US006040813A

United States Patent [19]

Takubo

[11] Patent Number: 6,040,813

[45] **Date of Patent: *Mar. 21, 2000**

[54] ACTIVE MATRIX LIQUID CRYSTAL DISPLAY DEVICE AND A METHOD FOR DRIVING THE SAME

[75] Inventor: Yoneharu Takubo, Ishikawa, Japan

[73] Assignee: Matsushita Electric Industrial Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/762,563

[22] Filed: Dec. 9, 1996

[30] Foreign Application Priority Data

Dec. 12, 1995 [JP] Japan ..... 7-322106

[51] Int. Cl.[7] ..... G09G 3/36

[52] U.S. Cl. ..... 345/92; 345/58; 345/90; 345/100; 349/38; 349/39

[58] Field of Search ..... 345/58, 90, 92, 345/93, 96, 100, 103; 349/38, 39, 41, 42, 139, 143

[56] References Cited

U.S. PATENT DOCUMENTS 5,122,790 6/1992 Yasuda et al. ..... 340/784
5,132,677 7/1992 Nicholas ..... 340/784
5,296,847 3/1994 Takeda et al. ..... 345/92
5,463,483 10/1995 Yamazaki ..... 359/58
5,706,023 1/1998 Nagata et al. ..... 345/92

FOREIGN PATENT DOCUMENTS 6-148675 5/1994 Japan .

*Primary Examiner*—Steven J. Saras
*Assistant Examiner*—John G. Lim
*Attorney, Agent, or Firm*—Merchant & Gould P.C.

[57] ABSTRACT

To provide a structure and a method for driving an active matrix liquid crystal display device having low electric power consumption and high quality image. The active matrix liquid crystal display device of the present invention comprises a plurality of scanning lines and a plurality of signal lines which are disposed in matrix, and a thin film transistor (TFT) and a pixel electrode corresponding to each combination of scanning line and signal line. The scanning line corresponding to each of the pixel electrodes is located on the upper and lower sides of the pixel electrode. The TFT is formed between the scanning line corresponding to the pixel electrode and upper and/or lower portion of the scanning line. An additive capacity is formed between the pixel electrode and a scanning line other than the scanning line corresponding to the pixel electrode. The stored capacity is formed between its corresponding scanning line and one line upper scanning line or between its corresponding scanning line and one line lower scanning line. The stored capacity is located alternately on the neighboring signal lines.

11 Claims, 3 Drawing Sheets

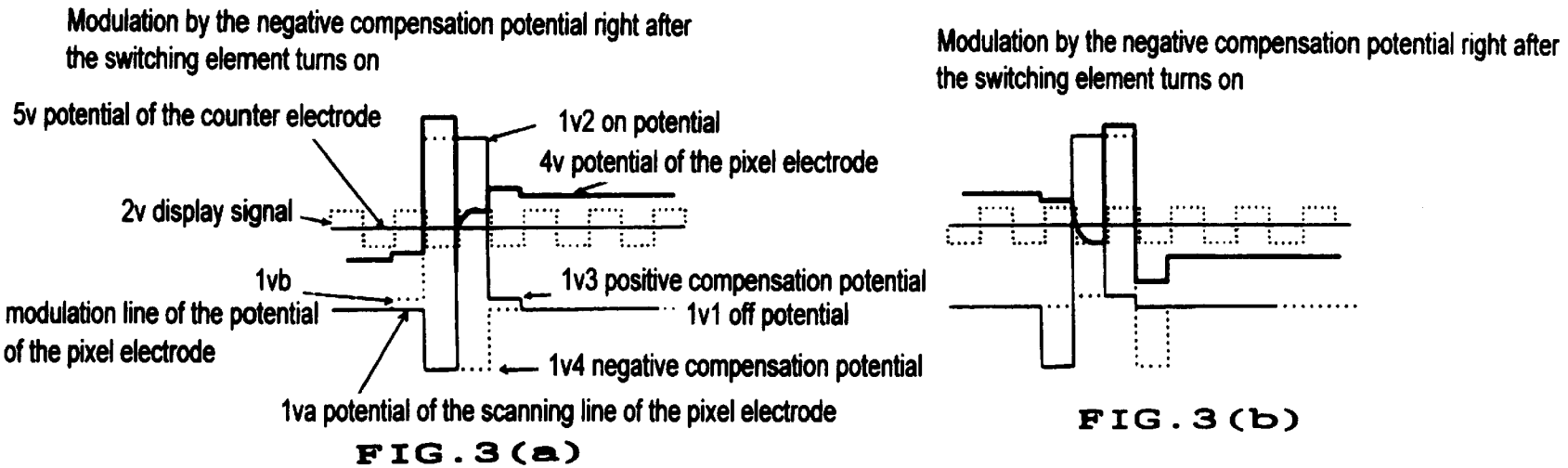
FIG. 3(a)
FIG. 3(b)
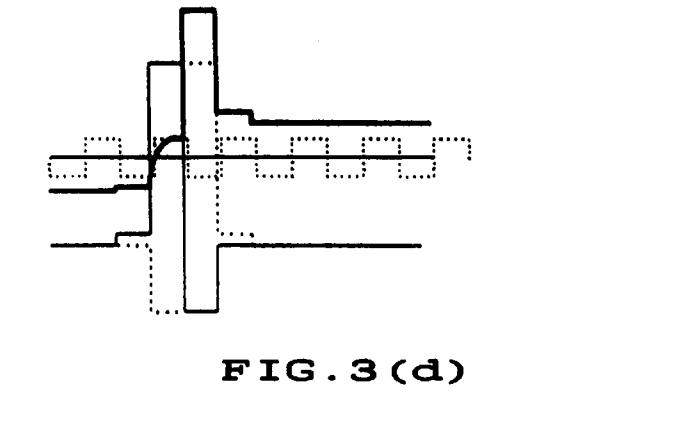
FIG. 3(c)
FIG. 3(d)

ACTIVE MATRIX LIQUID CRYSTAL DISPLAY DEVICE AND A METHOD FOR DRIVING THE SAME

BACKGROUND OF THE INVENTION

The invention relates to an active matrix liquid crystal display device and a method for driving the same. More specifically, the invention relates to a large and high definition liquid crystal display device permitting a low driving electrode power and high quality image and a method for driving the same.

BACKGROUND OF THE INVENTION

Currently, a display device using liquid crystal is applied to various fields, such as, a view finder of a video camera, a pocket television, a definition projection type television and information terminals of a personal computer or a word processor or the like. Recently, efforts have been made to develop and commercialize liquid crystal display devices. In particular, since an active matrix liquid crystal display device permits a high quality image, it has received much attention. An active matrix system means there is a system for driving the liquid crystal, as when compared with a conventional simple matrix system. The method for driving the matrix system generally includes providing each switching element with a pixel electrode disposed on the matrix, and separately supplying the electrical signals which inhibit the optical property of liquid crystal to each pixel electrode via the switching element. A thin film transistor (TFT) is mainly employed for the switching element. The active matrix liquid crystal display device can controls the voltage applied to this liquid crystal by means for the switching element provided on each pixel electrode. Consequently, crosstalk, which was generated when a simple matrix system was used, is theoretically not generated. Therefore it can be said that an active matrix liquid crystal display device is suited to a multi gradation display. In addition, various panel structures and driving methods are known and have the aim of achieving, with active matrix display devices, low usage of electric power and high quality image.

In particular, in Japanese Laid Open Patent No. Tokkai Hei 02-000913 and 02-157815, the driving method is disclosed in which the electric potential of the pixel electrode is modulated by altering the electric potential of the scanning line which is capacitively coupled to the pixel electrode (hereinafter, the capacitively coupled driving method). In this method, the signal voltage amplitude can be decreased while the electric potential of the counter electrode remains constant. Accordingly, this driving method apparently consumes low electric power and is said to be very efficient.

However, the above-mentioned conventional capacitively coupled driving method has problems. For example, crosstalk is generated in the horizontal direction resulting from an increase in the load of the counter electrode in the case of an engineering work station which is very large in size and which requires a high capacity. In particular, the problem of crosstalk in the horizontal direction being generated on the screen is a serious problem in terms of the quality of the image. Crosstalk in the horizontal direction is a phenomenon where a domain which should have uniform brightness depends on another pixel pattern which turns on at the same time, so that nonuniform brightness is generated.

The reason why such crosstalk in the horizontal direction is generated is that the electric potential of the counter electrode is distorted due to a change in the electric potential of the signal line which is capacitively coupled to the counter electrode, so that the desired voltage cannot be applied to the liquid crystal. According to the conventionally known driving method where the direction of changing the potential of the signal line is inverted for each signal line. That is, the polarity of the voltage is inverted for each signal line (hereinafter, the column inverting driving method), and distortion towards the counter electrode is cancelled by the neighboring electric potential of the signal line. As a result, crosstalk in the horizontal direction is not observed. However, there exists the problem that signal amplitude is large. Moreover, in order to realize the combining of the above-mentioned capacitively coupled driving method and the column inverting driving method, a structure in which a stored capacity formed between the pixel electrode and the scanning line is alternately located to the upper and lower sides of the scanning line corresponding to each pixel electrode is also disclosed (See Japanese Laid Open Patent No. Tokkai Hei 6-148675).

However, there is a problem in No. Tokkai Hei 6-148675. The problem is that the voltage applied to the pixel electrode in alternately displaced by line voltage with respect to the scanning direction.

SUMMARY OF THE INVENTION

A primary object of the present invention is to provide an active matrix liquid crystal display device which has low usage of electric power and high quality image while retaining the characteristics of the capacitively coupled driving method and while cancelling crosstalk in the horizontal direction. In order to achieve the above-mentioned object, the present invention provides the method where the column inverting driving method and the capacitively coupled driving method are combined without displacing the pixel electrode with respect to each scanning line.

In order to accomplish this and other objects and advantages, the active matrix liquid crystal display device of the present invention comprises a plurality of scanning lines and a plurality of signal lines which are disposed in matrix, at least one switching element and pixel electrode provided therewith corresponding to the combination of scanning line and signal line, the scanning line corresponding to each of the pixel electrodes respectively being located on the upper and lower sides of the pixel electrode, the switching element being provided on at least one side of the scanning line of each pixel electrode, and an additive capacity being formed between the pixel electrode and a scanning line other than the scanning line corresponding to the pixel electrode.

It is preferable in the above-mentioned active matrix liquid crystal display device that a scanning line on which the additive capacity is formed between the scanning line and the pixel line differs line by line relative to the signal lines.

It is preferable that the above-mentioned active matrix liquid crystal display device comprises a means for inverting the polarity of the electric potential of the signal line for each scanning line.

It is preferable that the above-mentioned active matrix liquid crystal display device comprises a means for transmitting the electric potential of the signal line to the pixel electrode when the switching element turns on and a means for modulating the electric potential of the pixel electrode by changing the electric potential of the scanning line on which the additive capacity is formed between the scanning line and the pixel line into the opposite direction when the switching element turns off.

It is preferable that the above-mentioned active matrix liquid crystal display device comprises a means for supplying the electric potential of the scanning line used for modulating the electric potential of the pixel electrode into the opposite direction before and after the selection period of the scanning line.

It is preferable that the above-mentioned active matrix liquid crystal display device further comprises a means for changing the electric potential for modulating the electric potential of the pixel electrode into the opposite directions before and after the selection period of the scanning line.

It is preferable in the above-mentioned active matrix liquid crystal display device that the amplitude center of the electric potential of the signal line is conformed to the amplitude center of the electric potential of the pixel electrode by comprising a means for supplying the electric potential of the scanning line for modulating the electric potential of the pixel electrode before and after the selection period of the scanning line and a means for changing the electric potential of the scanning line before and after the selection period of the scanning line.

According to another aspect of the present invention, the method for driving the active matrix liquid crystal display device of the present invention comprises a plurality of scanning lines and a plurality of signal lines which are disposed in matrix, at least one switching element and pixel electrode being provided and corresponding with each combination of scanning line and signal line, the scanning line corresponding to each of the pixel electrodes being located on the upper and lower sides of the pixel electrode, the switching element being provided on at least one side of the scanning line of each pixel electrode, and an additive capacity being formed between the pixel electrode and a scanning line other than the scanning line corresponding to the pixel electrode. In this way, the electric potential of the signal line is transmitted to the pixel electrode when the switching element turns on; the electric potential of the scanning line is oriented in the opposite direction line by line relative to the signal lines; and thereby the electric potential of the pixel electrode is modulated.

It is preferable in the above-mentioned method for driving the active matrix liquid crystal display device that a scanning line on which the additive capacity is formed between the scanning line and said pixel line differs line by line relative to the signal line.

It is preferable that the above-mentioned method comprises a means for inverting the polarity of the electric potential of the signal line for each corresponding to scanning line.

It is preferable in the above-mentioned method that the electric potential of the pixel electrode modulates the electric potential of the scanning line before and after the selection period of the scanning line.

It is preferable in the above-mentioned method that the electric potential of the pixel electrode changes the electric potential of the scanning line to opposite directions before and after the selection period of the scanning line.

It is preferable in the above-mentioned method that the amplitude center of the electric potential of the signal line is conformed to the amplitude center of the electric potential of the pixel electrode by supplying the electric potential of the scanning line for modulating the electric potential of the pixel electrode to opposite directions before and after the selection period of the scanning line and changing the electric potential of the scanning line before and after the selection period of the scanning line.

According to the above-mentioned active matrix liquid crystal display device and its driving method, there can be provided an active matrix liquid display device could be provided without displaceing the pixel potential by combining the capacitively coupled driving method and the column inverting method. Consequently, with keeping the capacitively coupled driving method, crosstalk in the horizontal direction, which was the biggest problem for realizing a large-sized and high definition panel, can be completely cancelled. Thus, an active matrix liquid crystal display device having low usage of electric power and a high quality image can be obtained.

BRIEF DESCRIPTION OF THE DRAWINGS

FIG. 2(*b*) is a waveforms explaining a scanning signal supplied to the scanning line of the active matrix liquid crystal display device of one embodiment of the present invention.

FIG. 2(*c*) is a waveforms explaining a display signal supplied to the scanning line of the active matrix liquid crystal display device of one embodiment of the present invention.

FIG. 3(*a*) is waveforms showing the modulation by the negative compensation potential right after the switching element turns on in one embodiment of the present invention.

FIG. 3(*b*) is waveforms showing the modulation by the positive compensation potential right before the switching element turns on in one embodiment of the present invention.

FIG. 3(*c*) is waveforms showing the modulation by the positive compensation potential right after the switching element turns on in one embodiment of the present invention.

FIG. 3(*d*) is waveforms showing the modulation by the negative compensation potential right before the switching element turns on in one embodiment of the present invention.

DETAILED DESCRIPTION OF THE INVENTION

Figure 1:
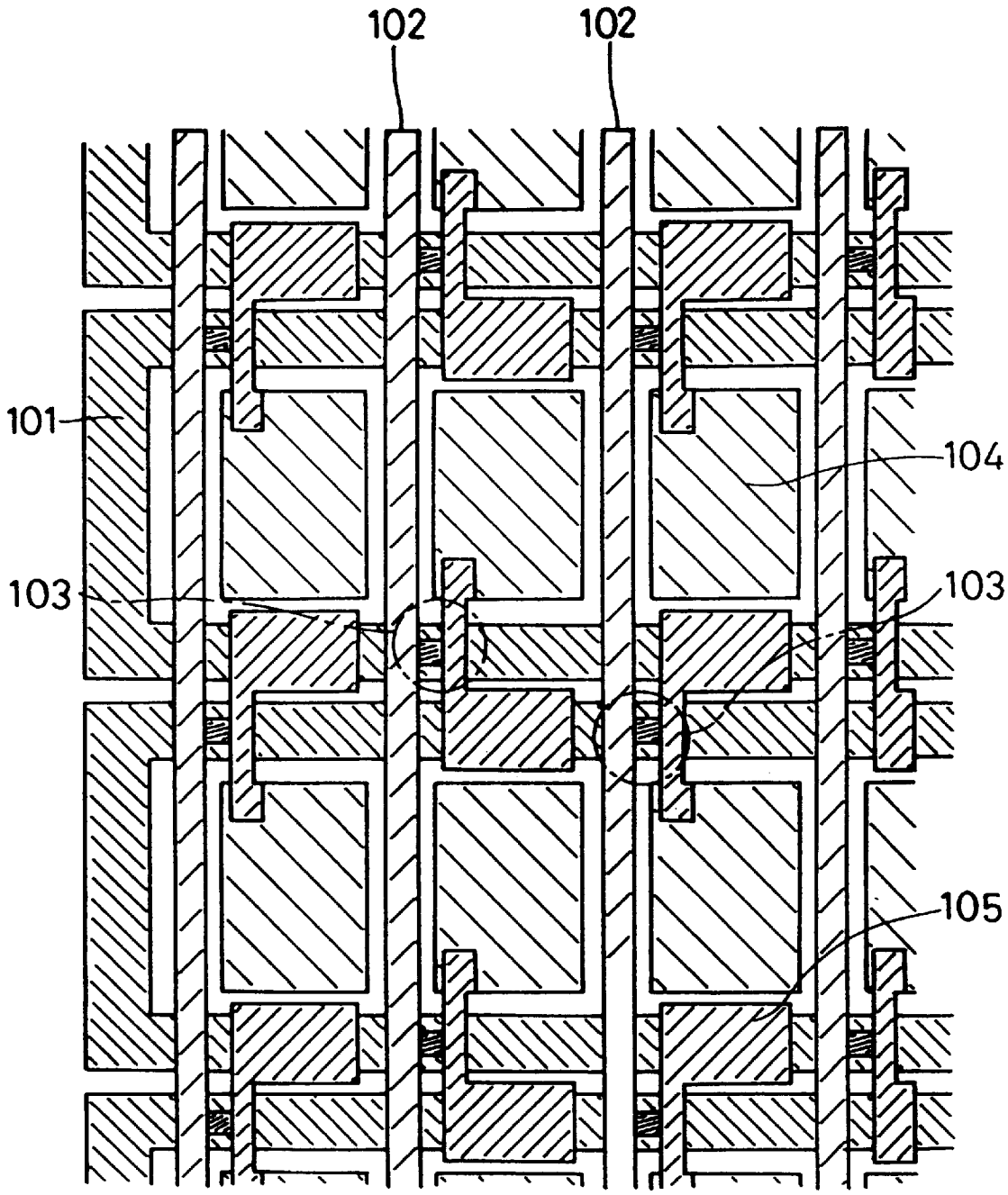
FIG. 1 is a schematic diagram showing the planar structure of the pixel portion of the active matrix liquid crystal display device of one embodiment of the present invention.
Figure 2A:
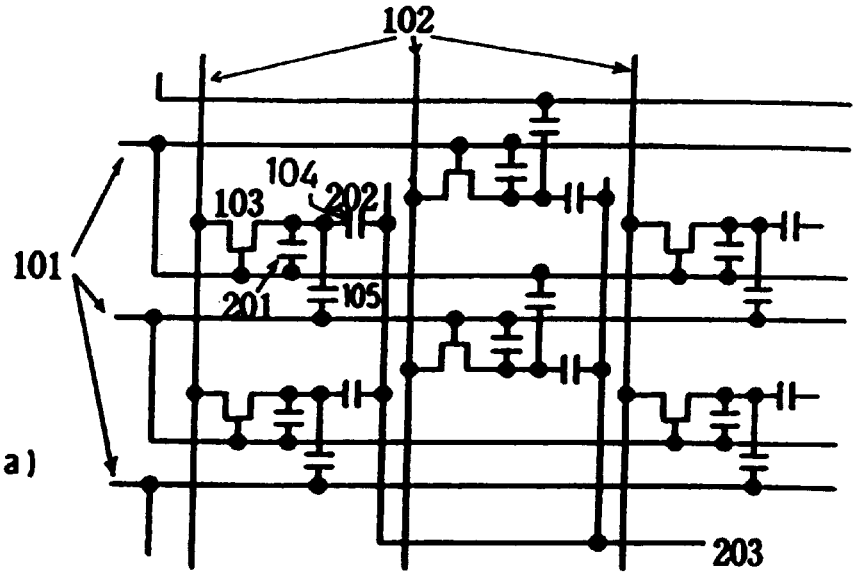
FIG. 2(*a*) is an equivalent circuit of the pixel portion of the active matrix liquid crystal display device of one embodiment of the present invention.
Figure 2B:
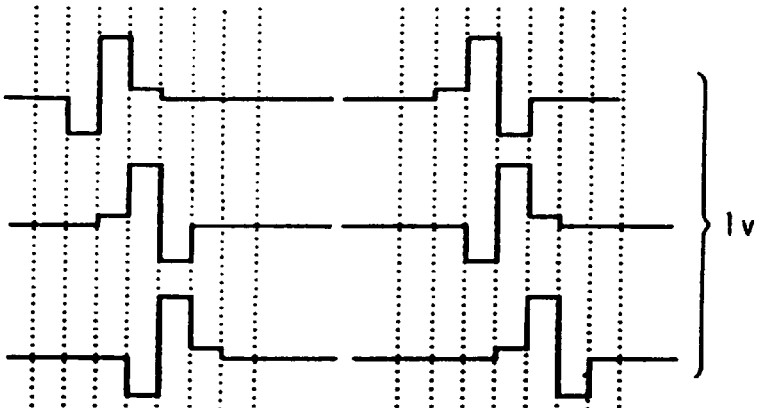
Figure 2C:
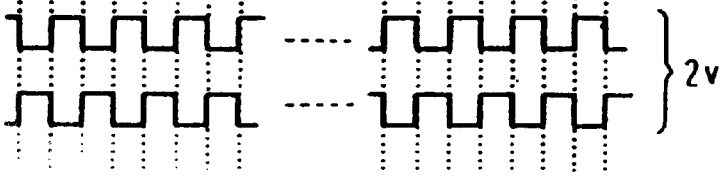

FIG. 1 illustrates a schematic diagram showing the planar structure of the pixel portion of the thin film transistor array of the active matrix liquid crystal display device of one embodiment of the present invention. FIG. 2 illustrates an equivalent circuit for the geometry of the pixel portion of the active matrix liquid display device shown in FIG. 1. The thin film transistor array of FIG. 1 and FIG. 2 includes a scanning line 101; a signal line 102; a reversed stagger type thin film transistor (TFT) 103; and a pixel electrode 104. Pixel electrode 104 is made of a transparent conductive thin film. Scanning line 101 is divided into two parts and is located along the upper and lower sides of each pixel electrode 104. In FIG. 2, the pixel electrode 104 is electrically coupled to the signal line 102 via the TFT 103, and thereby the electrical conductive condition between the signal line 102 and pixel electrode 104 is controlled. A stored capacity 105 is formed between the pixel electrode 104 and the scanning line 101. The stored capacity 105 is located between the scanning line corresponding to the stored capacity 105 and the scanning line which is located one line upper or between the scanning line corresponding to the stored capacity 105 and the scanning line which is located one line lower. The stored capacity 105 is located line by line relative to the signal lines.

The waveform and operation of the driving signal applied to the active matrix liquid display device shown in FIG. 1 will now be explained with reference to FIG. 2.

In FIG. 2(*a*), a parasitic capacity 201 is generated between the gate of the thin film transistor 103 and the pixel electrode 104 (hereinafter, $C_{gd}$). A static capacity 202 is formed by a liquid crystal layer between the pixel element electrode 104 and the counter electrode 203 (hereinafter, $C_{lc}$). As stated above, the stored capacity 105 (hereinafter, $C_{st}$) is alternately formed between different scanning lines, that is, between the scanning line corresponding to the stored capacity 105 (mid-line) and the scanning line which is one line upper of the mid-line and between the mid-line and the scanning line which is one line lower. FIG. 2(*b*) shows the waveforms of the three of the scanning lines supplied to the corresponding scanning lines. Each waveform has compensation potential of the positive side, on potential, and compensation potential of the negative side. FIG. 2(*c*) shows the waveforms of the two of the corresponding signal lines. The polarity of the display signal is reversed line by line relative to the signal lines.

Referring now to FIG. 3, the relationship between the waveforms provided to each line and the drive potential of the pixel electrode will now be explained. In the structure of the present invention, there exists a pixel electrode formed between its corresponding scanning line and one line upper scanning line, and a pixel electrode is formed between its corresponding scanning line and one line lower scanning line. FIG. 3(*a*) illustrates the modulation by the compensation potential of the negative side right after the switch element turns on; and FIG. 3(*b*) illustrates the modulation by the compensation potential of the positive side right after the switch element turns on. In FIG. 3(*a–d*), 1va is the electric potential applied to the scanning line coupled to the TFT gate electrode of the pixel electrode; 1vb is the electric potential applied to the scanning line coupled to the pixel electrode via the stored capacity; 1v1 represents the TFT off potential level; 1v2 represents the TFT on electric level; 1v3 represents the compensation potential (+) level; 1v4 represents the compensation potential (−) level; 4v represents the electric potential transmitted to the pixel electrode; and 5v shows the electric potential of the counter electrode (constant value). The compensation voltage is applied when the switch element of TFT turns from on to off. In the polarity of the display signal 2v, the phase is inverted line by line relative to the signal lines (column inversion) and the polarity of the compensation voltage inverts before and after the TFT turns on in accordance with the above-mentioned column inversion. Moreover, the display signal 2v inverts line by line relative to the scanning lines (hereinafter, H inversion will be used). The polarity of the compensation voltage inverts line by line relative to the scanning lines in accordance with the display signal. The potential of the pixel element electrode is shown in 4v when the electric potential shown in FIG. 3 (*a–d*) is applied to the structure of FIG. 2(*a*). Hereinafter, when the following equation 1 was satisfied, each potential value was controlled so that the value represented by the equation 2 was 0.

Equation 1:

$$C_{tot}=C_{lc}+C_{st}+C_{gd}$$

$$k_{tg}=C_{gd}/C_{tot}$$

$$k_{zg}=C_{st}/c_{tot}$$

wherein $C_{tot}$ represents the capacity of the pixel electrode; $C_{lc}$ represents the liquid crystal capacity; $C_{st}$ represents the stored capacity; $C_{gd}$ represents the parasitic capacity between the gate and pixel electrode; $k_{tg}$ represents the ratio of the parasitic capacity of the transistor to the pixel capacity; and $k_{zg}$ is the ratio of the stored capacity and the pixel capacity Equation 2;

$$k_{tg}(V_{(on)}-V_{(off)})+k_{zg}(V_{ge}(+)+V_{ge}(-))/2$$

wherein $V_{(on)}$ represents the electric potential of the scanning line when the switching element turns on; $V_{(off)}$ represents the electric potential of the scanning line when the switching element turns off; $V_{ge}(+)$ represents the electric potential of the scanning line (compensation voltage of the positive side); and $V_{ge}(-)$ represents the electric potential of the scanning line (compensation voltage of the negative side).

Since the amplitude center of the display signal, that of the electric potential of the pixel electrode, and that of the electric potential of the counter electrode are conformed to each other, DC component resulting from the dielectric aeoroteropy of liquid crystal does not appear. In addition, the voltage applied to liquid crystal can be increased while keeping the amplitude of the display signal small, thus permitting a low consumption of electric power.

Actually, the electric potential shown in FIG. 3(*a–d*) was applied to a liquid crystal panel having a TFT array structure which was shown in FIG. 1, and the effect of the improvement of the property was examined. The window-like pattern was displayed on the screen and the waveforms of the counter electrode were observed. As a result, the voltage amplitude component due to the electric potential of the signal line was not observed. Moreover, when visual observation of the actual screen was carried out, crosstalk in the horizontal direction was completely cancelled.

Moreover, the display signal was supplied by the H inverting method in the embodiment of the present invention. However, it is understood that the so-called 1F inverting driving method, which inverts the voltage polarity of the signal for each frame, can also be employed.

As stated above, according to the active matrix liquid crystal display device and the method for driving the active matrix liquid crystal display device of the present invention, the stored capacity can be formed relative to the pixel electrode between different scanning lines line by line relative to the signal lines by dividing the scanning line into two to provide each pixel electrode. Consequently, in this structure of the active matrix liquid crystal display device, the modulation polarity applied to the pixel electrode can be inverted line by line relative to the signal lines while the switching element turns off. In other words, column inversion is possible using the capacitively coupled driving method in the active matrix liquid crystal display device. In this structure of the active matrix liquid crystal display device, the distortion can be cancelled in the counter electrode while keeping the feature of capacitively coupled driving method. Moreover, crosstalk in the horizontal direction, which is one of the biggest problems in realizing a large and high definition panel, can be completely cancelled. Consequently, an active matrix liquid crystal display device having low usage of electric power and a high quality image can be obtained.

Finally, it is understood that the invention may be embodied in other specific forms without departing from the spirit or essential characteristics thereof. The embodiments disclosed in this application are to be considered in all respects as illustrative and not restrictive, so that the scope of the invention is indicated by the appended claims rather than by the foregoing description, and all changes which come within the meaning and range of equivalency of the claims are intended to be embraced therein.

What is claimed is:

1. An active matrix liquid crystal display device comprising a plurality of scanning lines and a plurality of signal lines which are disposed in a matrix to form combinations of one of said plurality of scanning lines and of one of said plurality of signal lines, said device further including a single switching element and a pixel electrode corresponding to each of said combinations of a first scanning line and a signal line; wherein said first scanning line corresponding to each of said pixel electrodes is located on both upper and lower sides of said pixel electrode, said switching element is provided on a single side of said first scanning line of each pixel, and an additive capacitance is formed between said pixel electrode and a second scanning line, said second scanning line being a scanning line other than said first scanning line in the combinations corresponding to said pixel electrode; and wherein a scanning line on which the additive capacitance is formed between said second scanning line and said pixel electrode associated with said first scanning line differs in subsequent scanning lines relative to said signal line.

2. The active matrix liquid crystal display device according to claim 1 comprising a means for inverting the polarity of the electric potential of said signal line for each scanning line.

3. The active matrix liquid crystal display device according to claim 1 comprising a means for transmitting the electric potential of said signal line to said pixel electrode when said switching element turns on and a means for modulating the electric potential of said pixel electrode by changing the electric potential of the scanning line on which the additive capacitance is formed between said second scanning line and said pixel line associated with said first scanning line to an opposite direction when said switching element turns off.

4. The active matrix liquid crystal display device according to claim 1 comprising a means for supplying the electric potential of the scanning line for modulating the electric potential of said pixel electrode to an opposite direction before and after the selection period of said scanning line.

5. The active matrix liquid crystal display device according to claim 1 further comprising a means for changing the electric potential for modulating the electric potential of said pixel electrode to an opposite direction before and after the selection period of said scanning line.

6. The active matrix liquid crystal display device according to claim 1, wherein an amplitude center of the electric potential of the of the display signal on the signal line is conformed to the amplitude center of an electric potential of the pixel electrode by comprising a means for supplying the electric potential of the scanning line for modulating the electric potential of said pixel electrode before and after a selection period and a means for changing the electric potential of the scanning line before and after said selection period.

7. A method for driving an active matrix liquid crystal display device comprising a plurality of scanning lines and a plurality of signal lines which are disposed in a matrix to form combinations of one of said plurality of scanning lines and of one of said plurality of signal lines, said device further including a single switching element and a pixel electrode corresponding to each of said combinations of a first scanning line and a signal line, said first scanning line corresponding to each of said pixel electrodes is located on both upper and lower sides of said pixel electrode, said switching element is provided on a single side of said first scanning line of each pixel, and an additive capacitance is formed between said pixel electrode and a second scanning line, said second scanning line being a scanning line other than said first scanning line in the combinations corresponding to said pixel electrode, wherein a scanning line on which the additive capacitance is formed between said second scanning line and said pixel electrode associated with said first scanning line differs in subsequent scanning lines relative to said signal line, said method comprising the steps of: transmitting the electric potential of the signal line to the pixel electrode when the switching element turns on; and changing the electric potential of the upper and lower parts of the scanning line to an opposite direction line by line relative to said signal lines; thereby modulating the electric potential of said pixel electrode.

8. The method for driving the active matrix liquid crystal display device according to claim 7, comprising a means for inverting the polarity of the electric potential of said signal line for each corresponding scanning line.

9. The method for driving the active matrix liquid crystal display device according to claim 8, wherein the electric potential of each scanning line is supplied for modulating the electric potential of said pixel electrode before and after the selection period of said scanning line.

10. The method for driving the active matrix liquid crystal display device according to claim 9, wherein the electric potential of the scanning line for modulating the electric potential of said pixel electrode is changed to the opposite direction before and after the selection period of said scanning line.

11. The method for driving the active matrix liquid crystal display device according to claim 7, wherein an amplitude center of the electric potential of the display signal on the signal line is conformed to the amplitude center of an electric potential of the pixel electrode by by supplying the electric potential of the scanning line for modulating the electric potential of said pixel electrode before and after the selection period of the scanning line into the opposite direction before and after said selection period of the scanning line.

* * * * *